US008668465B2

(12) United States Patent
Wadsley et al.

(10) Patent No.: US 8,668,465 B2
(45) Date of Patent: Mar. 11, 2014

(54) HYDRAULIC SYSTEM WITH SUPPLEMENT PUMP

(75) Inventors: Luke Wadsley, Ames, IA (US); Niall Caldwell, Edinburgh (GB)

(73) Assignee: Sauer-Danfoss Aps, Nordborg (DK)

( * ) Notice: Subject to any disclaimer, the term of this patent is extended or adjusted under 35 U.S.C. 154(b) by 316 days.

(21) Appl. No.: 12/740,783

(22) PCT Filed: Oct. 29, 2008

(86) PCT No.: PCT/DK2008/000386

§ 371 (c)(1),
(2), (4) Date: Aug. 30, 2010

(87) PCT Pub. No.: WO2009/056142

PCT Pub. Date: May 7, 2009

(65) Prior Publication Data

US 2010/0322791 A1 Dec. 23, 2010

(30) Foreign Application Priority Data

Nov. 1, 2007 (EP) ..... 07254330

(51) Int. Cl.
*F04B 23/08* (2006.01)
*F04B 49/06* (2006.01)
*F04B 53/10* (2006.01)

(52) U.S. Cl.
USPC ..... 417/216; 417/223; 417/244; 417/429; 417/286

(58) Field of Classification Search
USPC ..... 417/213, 216, 223, 429, 244, 286
See application file for complete search history.

(56) References Cited

U.S. PATENT DOCUMENTS 1,507,448 A 9/1924 Aldrich
3,319,419 A * 5/1967 Hann ..... 60/449
3,962,870 A * 6/1976 Lech ..... 60/428

(Continued)

FOREIGN PATENT DOCUMENTS

DE 4306377 A1 9/1994
EP 0361927 A1 4/1990

(Continued)

OTHER PUBLICATIONS

International Search Report dated Feb. 2, 2009 from Serial No. PCT/DK2008/000386.

(Continued)

*Primary Examiner* — Peter J Bertheaud
*Assistant Examiner* — Dominick L Plakkoottam
(74) *Attorney, Agent, or Firm* — McCormick, Paulding & Huber LLP

(57) ABSTRACT

If a hydraulic system has several modes of operation, in particular a mode with a high pressure demand (II) and a mode with a high fluid flow demand (II), the hydraulic fluid pump has to be built with an accordingly high fluid flow output. Such a pump is expensive. Therefore it is suggested, to provide two pumps. I.e. a controllable main pump (2) is provided, which supplies the hydraulic consumer (6) during phases (I) of high pressure demand. During phases (II) of high fluid flow demand, normally, relatively low pressures are sufficient. Therefore, it is suggested to provide a parallel boost pump (9), which supplies the hydraulic consumer (6) in addition to the high pressure pump (2), if a high fluid flow is needed. Excess fluid flow output is avoided by controlling the fluid output flow of main pump 2.

12 Claims, 11 Drawing Sheets

(56) References Cited

U.S. PATENT DOCUMENTS

| | | | | | |
|---|---|---|---|---|---|
| 3,985,472 | A | * | 10/1976 | Virtue et al. | 417/216 |
| 4,321,014 | A | | 3/1982 | Eburn, Jr. et al. | |
| 4,382,485 | A | * | 5/1983 | Kirkham | 180/306 |
| 4,813,234 | A | * | 3/1989 | Nikolaus | 60/484 |
| 4,815,946 | A | | 3/1989 | Cusack | |
| 5,046,926 | A | | 9/1991 | Deininger et al. | |
| 5,165,862 | A | * | 11/1992 | Lindblom | 417/216 |
| 5,176,504 | A | * | 1/1993 | Moriya et al. | 417/216 |
| 5,186,612 | A | | 2/1993 | Budzich | |
| 5,190,446 | A | | 3/1993 | Salter et al. | |
| 5,354,180 | A | * | 10/1994 | Forster | 417/199.1 |
| 5,527,156 | A | * | 6/1996 | Song | 417/2 |
| 5,636,975 | A | | 6/1997 | Tiffany et al. | |
| 5,700,136 | A | * | 12/1997 | Sturman | 417/270 |
| 5,921,759 | A | | 7/1999 | Khan | |
| 6,029,445 | A | * | 2/2000 | Lech | 60/422 |
| 6,055,851 | A | | 5/2000 | Tanaka et al. | |
| 6,126,418 | A | | 10/2000 | Sinnl | |
| 6,183,207 | B1 | * | 2/2001 | Sturman | 417/53 |
| 6,283,724 | B1 | | 9/2001 | Alaze et al. | |
| 6,681,571 | B2 | | 1/2004 | Bailey et al. | |
| 6,682,316 | B1 | | 1/2004 | Boke | |
| 2002/0001526 | A1 | * | 1/2002 | Howard | 417/286 |
| 2004/0055580 | A1 | | 3/2004 | Yamada et al. | |
| 2004/0091365 | A1 | | 5/2004 | Spiegl et al. | |
| 2004/0105763 | A1 | | 6/2004 | Kondo | |
| 2006/0039795 | A1 | | 2/2006 | Stein et al. | |
| 2006/0239846 | A1 | | 10/2006 | Oda et al. | |
| 2008/0141670 | A1 | * | 6/2008 | Smith | 60/484 |
| 2008/0245323 | A1 | * | 10/2008 | Williamson et al. | 123/90.12 |
| 2009/0113888 | A1 | * | 5/2009 | Kuttler et al. | 60/486 |
| 2009/0120086 | A1 | | 5/2009 | Kuttler et al. | |

FOREIGN PATENT DOCUMENTS

| | | | |
|---|---|---|---|
| EP | 0494236 | B1 | 7/1992 |
| EP | 0577783 | B1 | 1/1994 |
| EP | 1319836 | A2 | 6/2003 |
| EP | 1469237 | A1 | 10/2004 |
| EP | 1537333 | B1 | 8/2005 |
| EP | 2055943 | A1 | 6/2009 |
| EP | 2055944 | A1 | 6/2009 |
| EP | 2055945 | A1 | 6/2009 |
| EP | 2055946 | A1 | 6/2009 |
| GB | 968452 | | 9/1964 |
| GB | 1374752 | A | 11/1974 |
| WO | 9105163 | A1 | 4/1991 |
| WO | 2004025122 | A1 | 3/2004 |

OTHER PUBLICATIONS

International Search Report dated Feb. 2, 2009 from Serial No. PCT/DK2008/000385.

International Search Report dated Feb. 2, 2009 from Serial No. PCT/DK2008/000382.

International Search Report dated Feb. 2, 2009 from Serial No. PCT/DK2008/000381.

International Search Report dated Feb. 2, 2009 from Serial No. PCT/DK2008/000384.

* cited by examiner

HYDRAULIC SYSTEM WITH SUPPLEMENT PUMP

CROSS REFERENCE TO RELATED APPLICATIONS

This application is entitled to the benefit of and incorporates by reference essential subject matter disclosed in International Patent Application No. PCT/DK2008/000386 filed on Oct. 29, 2008 and EP Patent Application No. 07254330.9 filed Nov. 1, 2007.

FIELD OF THE INVENTION

The invention relates to hydraulic systems with at least one hydraulic main pump and at least one hydraulic boost pump for supplying at least one hydraulic consumer. The invention further relates to a method for operating a hydraulic system. Furthermore the invention relates to a combined pumping system.

BACKGROUND OF THE INVENTION

Hydraulic systems are nowadays used in a plethora of technical applications.

In the beginning of hydraulic applications, mostly hydraulic cylinders were used to move heavy weights with high forces. Well known examples are doors for locks, lifting devices for the shovel of a wheel loader, for the fork of a fork-lift truck or for the trough of a dump truck.

However, hydraulic systems have evolved from these basic systems and more and more hydraulic applications have become common. For example, hydraulic systems are nowadays even used as power transmitting devices. The power output of a combustion engine drives a hydraulic pump. The hydraulic fluid, pumped by the hydraulic pump, is led to a hydraulic motor through hydraulic tubes. There, the pressure energy of the hydraulic fluid is converted back to mechanical movement. With increasing efficiencies, hydraulic systems become more and more competitive to traditional power transmissions. However, there are still problems involved with current hydraulic systems. For instance, one major disadvantage is the price for hydraulic systems.

The price problem becomes even stronger, if highly efficient pumps, such as synthetically commutated hydraulic pumps are used. Synthetically commutated hydraulic pumps are also known as digital displacement pumps. They are a unique subset of variable displacement pumps. A basic design is described in U.S. Pat. No. 5,190,446, EP-A-0361927 or US 2006-039795 A1, for example. Such synthetically commutated hydraulic pumps are in many ways superior to traditional hydraulic pumps. For instance they have a higher efficiency and they are more flexible when in use. For example, their fluid flow output can be changed easily by an appropriate actuation of the inlet (and in some cases even the outlet) valve of the synthetically commutated hydraulic pump. With an appropriate design and an appropriate actuation of the electrically actuatable valves, a reverse pumping mode and/or a motoring mode can be achieved as well for the synthetically commutated hydraulic pump.

However, synthetically commutated hydraulic pumps have short-comings as well. One of the chief shortcomings in the field of synthetically commutated hydraulic pumps is the usually high cost of synthetically commutated hydraulic pumps, when compared to the cost of traditional hydraulic pumps. Another problem is the fact, that synthetically commutated hydraulic pumps are normally physically larger for a given power unit displacement than conventional hydraulic pumps. Still another problem with synthetically commutated hydraulic pumps is that normally a significant amount of electrical power is required to rapidly and frequently actuate the actuated valves.

Moreover, synthetically commutated hydraulic pumps show their intrinsic technical advantages, when it comes to providing high pressures at relatively low flow rates. On the contrary, when there is a need for a cost effective pump that produces high hydraulic fluid flow rates at relatively low system pressures, synthetically commutated hydraulic pumps have been impractical so far. Therefore, in quite a lot of applications, traditional hydraulic pumps are still used, in spite of the availability of synthetically commutated hydraulic pumps. Admittedly, this is an acceptable work around in applications, where there is solely a demand for high hydraulic fluid flow at relatively low pressures. In applications, however, where there is at least during certain time intervals a demand for high pressures as well as for high flowrates at relatively low pressures, there is still no convincing solution so far. This is a big issue, because a large portion of todays hydraulic applications have exactly this type of hydraulic fluid demand. If you think of a wheel loader or a fork-lift truck, you have a need for a high hydraulic fluid flow rate at a low pressure, when the vehicle is to be moved by a hydraulic motor at higher speeds on plane grounds (e.g. when driving on a road). On the other hand, if you want to lift a heavy load with the lifting hydraulics of a fork-lift truck or a wheel loader, you have a need for hydraulic fluid at high pressures, whereas a low fluid flow rate is acceptable. The same situation can arise, if you have to drive the vehicle with a heavy load up a steep incline.

One traditional way to cope with this problem would be to provide a high pressure pump of a large size, so that the high pressure pump can provide a large fluid flow output. However, this approach is not very cost effective.

Another text book approach for such a situation is to provide for a parallel arranged high pressure pump and a high volume low pressure pump. Whereas the high pressure pump is always connected to the hydraulic consumer, the high volume low pressure pump is connected to the hydraulic consumer side via a check valve, which opens only, if the pressure on the hydraulic consumer side is sufficiently low. A big problem with such parallely arranged pumps is the controllability of the fluid output flow. According to the state of the art, both high pressure and low pressure pumps are pumping under all conditions at maximum pumping rate. If the fluid flow demand of the consumers is lower than the fluid output flow of the pump arrangement, any excess fluid flow is simply dumped back into the hydraulic fluid reservoir via pressure relief valves. While such arrangements work well, their energy efficiency is usually unsatisfactorily low. Especially under low fluid flow conditions, energy is wasted by first raising the pressure of hydraulic fluid and then dumping said fluid right afterwards without performing any useful work. The design however, is necessary to provide for a smooth transition, particularly in the transition area, when the fluid output flow of the high volume low pressure pump starts in or fades out, respectively. An additional problem with such a system is that it is normally incapable of providing low pressure flow at low flow rates without additional system complexity because the check valve is in the low pressure pump flow below a certain pressure level, not based on a flow demand.

SUMMARY OF THE INVENTION

The object of the invention is therefore to provide a hydraulic system, which is able to provide an energy-efficient hydraulic fluid flow at low cost.

It is proposed, to design a hydraulic system with at least one hydraulic main pump and at least one hydraulic boost pump for supplying at least one hydraulic consumer, wherein said first hydraulic consumer is connected to the output fluid flow of said hydraulic main pump in a standard operation mode and the output fluid flow of said hydraulic boost pump is selectively added to the output fluid flux of said hydraulic main pump in a boost mode in a way that the combined fluid output flow rate of said hydraulic main pump and said hydraulic boost pump is at least in part regulated by the fluid output flow rate of the main pump. Because the fluid output flow rate of the pump arrangement can be regulated according to the actual demand, it can be avoided, that under low fluid flow demand conditions, a significant amount of high pressure fluid has to be dumped, without performing any useful work. Therefore, the energy efficiency of the proposed hydraulic system can be increased significantly. A key point is that the fluid output flow rate of the main pump is at least in part regulated. Otherwise, dumping of highly pressureised fluid had to be done at a significant flow rate under certain conditions. Such a dumping of high pressure fluid is particularly bad, because the corresponding energy losses are particularly high. Furthermore, the possibility to regulate the fluid output flow rate of the hydraulic main pump is vital in the transition region, when the fluid flow output of the boost pump starts in, or fades out of the combined fluid output flow rate.

The pumps can be chosen in way, that the maximum output pressure, achievable by said hydraulic main pump is higher than the maximum output pressure, achievable by said hydraulic boost pump. With such an arrangement, the achievable pressure range can be increased. The proposed system is especially well-suited for systems which have requirements for a high pressure during one part of operation and a high flow rate during another part of operation, but it is not possible, due to available power limitation or it is not a duty cycle requirement, to operate both at high pressure and high flow rate at the same time. A main advantage of such a system can be that the boost pump can be selected to have a lower maximum pressure capability than the main hydraulic pump, thus reducing system cost. Particularly, the high level pressure, i.e. the maximum output pressure, achievable by the hydraulic main pump can be in the order of 200 bar, 250 bar or 300 bar, 350 bar, 400 bar, 450 bar or 500 bar. The low pressure level, i.e. the maximum output pressure, achievable by the hydraulic boost pump can be chosen to be in the order of 10 bar, 15 bar, 20 bar, 30 bar, 40 bar, 50 bar, 100 bar, 150 bar, 200 bar, 250 bar or 300 bar.

With such a design, a pump arrangement for the supply of at least one hydraulic consumer can be provided, that is able to provide a high pressure, low flow rate hydraulic fluid flow as well as a high flow rate, low pressure fluid flow in an economical way. Therefore, the proposed pump arrangement can be the sole hydraulic pump system for a wheel loader, a fork-lift truck or similar machinery. Because it is possible, to use a main (high pressure) pump with a limited output fluid flow rate, the high costs for a main (high pressure) pump with high maximum fluid flow rate can be avoided. Nevertheless the negative consequences, involved with low maximum fluid flow rates over the whole pressure range, can be avoided as well. Therefore, a vehicle, driven by hydraulic motors (such as wheel loaders or fork-lift trucks) can still be propelled on a road at considerable speeds.

Of course, it is also possible that the maximum output pressure of the main pump(s) and the boost pump(s) is the same or at least similar. In this case, the previously mentioned pressure levels for the main pump should be applied for both pumps. Such an arrangement normally has to be used in systems where there exists operating conditions where both high pressure and high flow rates are required and that enough mechanical power is available to supply this total amount of high pressure fluid flow.

A preferred embodiment of the invention is achieved, if said hydraulic main pump is of a synthetically commutated type. Such a pump type is particularly advantageous, because the fluid output flow rate can be changed extremely quickly. Therefore, the fluid output flow rate of the main pump/the combined fluid output flow rate can be adapted to the actual demand very quickly. Therefore, a dumping of pressurised hydraulic fluid can be avoided or at least reduced to a very low level. Because of the possible quick changing of the fluid output flow rate of the synthetically commutated hydraulic pump, a smooth transition in the transition area, when the fluid output flow of the boost pump sneaks in or fades out, can be provided. Although theoretically this smooth transition could be accomplished using commonly available variable hydraulic pumps, it turns out that for practical applications this smooth transition is usually impossible to achieve, at least without adding considerable additional cost.

Even more preferred, the combined fluid output flow rate of the hydraulic main pump and the hydraulic boost pump is regulated essentially by the hydraulic main pump. This way, the control algorithms for controlling the respective pumps can be further simplified. Especially when using a synthetically commutated hydraulic pump, this embodiment normally yields the fastest response speed.

It is preferred, if at least one hydraulic boost pump is of a fixed fluid flow rate type, particularly of a cylinder and piston type. This way, the hydraulic boost pump can be built in a very simple way, thus reducing cost and complexity of controlling such a pump. By the expression "fixed fluid rate type" is not meant, that the hydraulic boost pump cannot be switched on and off (the same applies to the previous "essentially regulated by the hydraulic main pump"). Furthermore, it is of course possible, that the fluid output flow rate varies with the driving speed of the hydraulic boost pump, for example. However, no internal regulatory means are provided. Of course, apart from piston and cylinder type pumps, different pump designs are possible as well. For example, gear pumps, roller-vane pumps, gerotor type pumps and scroll pumps are possible as well.

A preferred set-up of the hydraulic system is achieved, if the maximum flow rate of the hydraulic main pump is (slightly) higher than the (combined) maximum fluid flow rate of the hydraulic boost pump(s). This way, an excellent controllability of the pump arrangement over the whole combined fluid flow output range can be provided for. Considering the expression "slightly higher", a ratio of 1.1, 1.2 or 1.3 can be used. If both the hydraulic main pump and the hydraulic boost pump are of the piston and cylinder type, this can be achieved by an appropriate ratio of the volume of the respective cylinders. For instance, the displacement (or the volume of the cylinders) of the main pump can be chosen to be 60 $cm^3$, while the displacement (or the volume of the cylinders) of the boost pump can be chosen to be 50 $cm^3$. When talking about displacement, the given volumes are understood to be the displacement per shaft revolution. This relationship between the displacement of the main hydraulic pump and the boost pump can also be extended to a case, where more than one boost pump is used, to further extend the flow range of the hydraulic system. For instance, in a system with one main hydraulic pump and two boost pumps, the displacement of the main pump can chosen to be 60 $cm^3$ per shaft revolution, while the displacement of each boost pump can be chosen to be 50 $cm^3$ per shaft revolution. Using such an arrangement, the effective variable displacement of the hydraulic system can be even further extended. The above mentioned ratios of pump displacement are usually used for the standard case, where the shafts of the main pump(s) and a boost pump(s) are rotating at the same rate. If the rotating speeds of the pumps are different from each other (for instance the rotation rate of the main pump is twice as high as the rotation rate of the boost pump) the displacements of the main pump(s) and/or the boost pump(s) are preferably adjusted accordingly. Also worth consideration is that the relative difference in pump flow could be accomplished in a way that the different flow rates are accomplished by different rotation rates of the respective pumps. For instance, in a two pump system (one main pump and one boost pump), the two pumps could both have displacements of 50 $cm^3$, but the main hydraulic pump could be rotated at a higher shaft speed than the boost pump to maintain a higher maximum flow rate potential. Of course, even more different modes of operation are possible as well.

Preferably, at least two hydraulic pumps are driven by the same power supply. By the expression "power supply", especially "mechanical power supply" devices such as combustion engines, electrical motors, turbines or the like have to be considered. Of course, it is possible, that any two of the hydraulic pumps can be driven by the same power supply (e.g. two high pressure pumps or two boost pumps). However, normally a pair of a hydraulic boost pump and a corresponding hydraulic main pump is driven by the same power supply. Of course, more or all of the hydraulic pumps present can be driven by the same power supply, as well.

Another embodiment of the invention can be realised, if at least one electric valve is provided. Such an electric valve can be controlled by an electronic controlling unit. In such an electronic controlling unit, a large number of sensor inputs can be used together with a characteristic control function, to provide an optimal control of the resulting hydraulic systems in almost every condition. Electric valves can be particularly useful, if several pumps (high pressure, main and/or boost pumps) and/or several hydraulic consumers are present. The electric valves can not only be used for switching the output fluid flow of a boost pump, but also for switching supply lines of hydraulic consumers and/or output lines of main pumps.

The hydraulic system can be arranged in a way that during said standard operation mode the excess fluid flow rate, delivered by said hydraulic boost pump, is dumped at least in part into a hydraulic fluid reservoir. A standard operation normally means that the hydraulic consumers are solely supplied by the hydraulic main pump. During such standard operation, the question arises what to do with an excess fluid flow, delivered by the hydraulic boost pump. While it is possible, to switch off the boost pump, e.g. by a clutch or a similar device, this can cause an additional complexity of the system. If, however, the excess fluid flow is simply dumped back into the hydraulic fluid reservoir system, the total arrangement can be kept very simple. Additionally, if the output fluid flow is simply dumped at approximately ambient pressure, the boost pump does not need a high power input. For dumping the output fluid flow of the boost pump, an electrically actuated valve, controlled by a controller can be used. Therefore the whole arrangement is still very power efficient.

According to another embodiment, the hydraulic system can be arranged in a way, that during the standard operation mode the excess fluid flow rate, delivered by the hydraulic boost pump, is used at least in part for a second hydraulic consumer. In this way, it can be avoided, that mechanical power is wasted. Also, the boost pump can be used for a sensible purpose, even if it is not used for the main hydraulic system. Of course, it is sensible to use for a second hydraulic consumer a device, for which it is not problematic or even harmful, if said device is not supplied with hydraulic fluid even for extended periods of time.

Preferably, a plurality of hydraulic consumers and, if necessary, even a plurality of hydraulic main pumps is provided. Such an arrangement is particularly useful, if the hydraulic consumers are in demand of a fluid flow (for example a high fluid flow) only from time to time. Therefore, the output of the boost pump can be used by several hydraulic consumers in a time sharing manner. Furthermore, the proposed arrangement makes sense because a boost pump with a very high fluid flow output can be provided easily. However, such a high flow boost pump can serve as a boost pump for several hydraulic consumers and/or main pumps.

In the proposed arrangement, it is preferred, if at least one hydraulic boost pump can be selectively connected to one or several hydraulic consumers. This selective control can be performed by an electronic controlling unit, which is already present in many hydraulic systems. This selective connection can lead to an optimum performance of the hydraulic system in practically all conditions the hydraulic system is likely to confront.

It is also possible to provide for a combined pumping system, comprising a main pumping part and a boost pumping part. This way, an integrated pump is provided, performing both the purposes of the previously described main pump and the purposes of the previously described boost pump, within one means. This can further reduce costs.

Preferably, within the combined pumping system, an electrically actuated valve for short-circuiting the boost pumping part of the combined pumping system is provided. This way, the previously described short-circuiting valve for the boost pump can be implemented in the combined pumping system. This can reduce costs as well.

Another solution is provided by a method for operating a hydraulic system, wherein the hydraulic system comprises at least one hydraulic main pump, at least one hydraulic boost pump and at least one hydraulic consumer, wherein said hydraulic consumer is driven by the fluid flow of said hydraulic main pump during a standard operation mode, while during a phase of high fluid flow demand by said hydraulic consumer, said hydraulic consumer is driven by the combined fluid flow of at least one hydraulic main pump and at least one hydraulic boost pump, and wherein the combined fluid flow rate of the hydraulic main pump and the hydraulic boost pump is varied based on the fluid flow demand of the hydraulic consumer at least in part by controlling the output fluid flow rate of the hydraulic main pump. By using such a method, the objects and advantages of the above described hydraulic system can be achieved in a similar way.

Furthermore, it is possible to further modify the proposed method by using the already described ideas in connection with the proposed hydraulic system. Of course, those ideas have to be appropriately adapted, if necessary. By appropriate modifications, the already mentioned objects and advantages of the invention can be achieved in an analogous way.

Yet another solution is provided by a combined pumping system, comprising a main pumping section and a boost pumping section. By such combined pumping system, a single pump body can perform both the work of a main pump as well as the work of a boost pump. The main pumping section can be built according to a synthetically commutated hydraulic pump. A single rotating shaft, to which a wobble plate is connected, can drive both pumping parts of the combined pumping system. Of course, ideas, described in other parts of the present application, can be used in connection with the proposed combined pumping system as well. Presumably, slight modifications of such ideas might be necessary.

BRIEF DESCRIPTION OF THE DRAWINGS

The objects and advantages as well as possible arrangements of the present invention will become more apparent when reading the following description of embodiments of the invention with reference to the enclosed figures. The enclosed figures show.

DETAILED DESCRIPTION OF THE PREFERRED EMBODIMENTS

Figure 10:
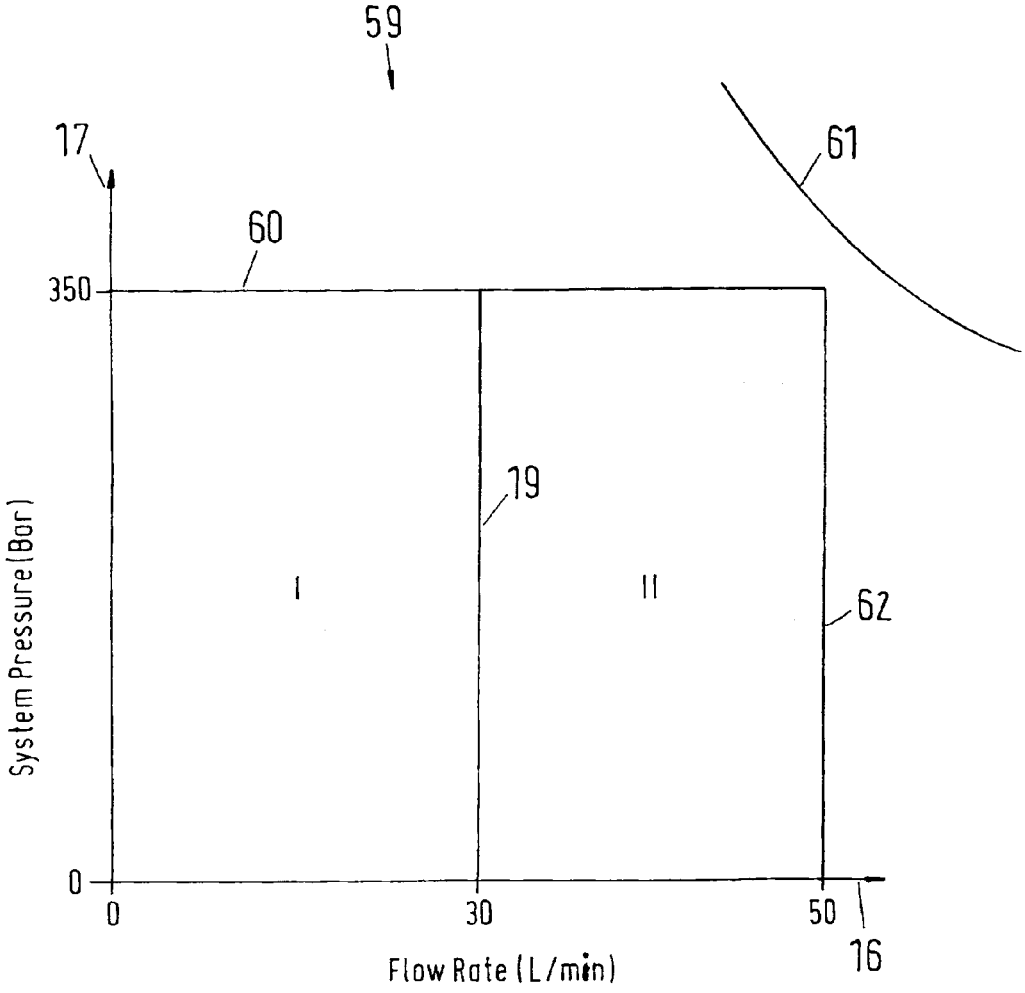
FIG. 10 is a pressure versus flow rate diagram without power limitation, illustrating different working modes.

FIG. 10 shows a pressure versus flow rate diagram 59, illustrating different working modes I and II. The flow rate is plotted in liters per minute on the abscissa 16. The system pressure is plotted in bars on the ordinate 17, with the maximum required system pressure represented by line 60. In the present example of FIG. 10, the power available from a mechanical power supply, represented by curve 61, exceeds the power which could potentially be drawn from the power supply by the hydraulic system. The maximum power which the hydraulic system could consume is located at the upper right corner of area II, at the intersection of the maximum required system pressure line 60 and the maximum required flow rate line 62. As can be seen from FIG. 10 there is some excess mechanical power supply in the depicted example. This can be seen from the distance between mechanical power limit line 61 and the upper right corner of area II. It is to be understood, that all system pressure/flow rate combinations within the area of the rectangle, formed by maximum required pressure line 60, maximum required flow rate line 62, abscissa 16 and ordinate 17 (including the respective lines) can be reached as well.

In a system designed according to the prior art, in order to function within the entire area of the pressure versus flow rate graph 59 (areas I and II), a variable pump with high pressure capability and high flow capability would need to be chosen. In the example of FIG. 10, such a large pump would then be able to function throughout both areas I and II. However, such a high flow rate, high pressure, variable pump is expensive.

However, the same areas I and II of the pressure versus flow rate diagram 59 represented in FIG. 10 can be functionally covered by two smaller flow rate pumps as well. Both pumps can have a high pressure capability, but only one of which is variable. Thus, to function in area I of FIG. 10, a small variable displacement synthetically commutated pump is used to provide a necessary fluid flow as the main pump. However, in order to function in area II of FIG. 10, a second fixed displacement pump's flow (boost pump) is added to the flow provided by the synthetically commutated pump. This allows that both areas I and II can be functionally covered by a relatively small and hence less expensive variable main pump and a relatively small inexpensive fixed displacement boost pump at a lower overall cost when compared to using a single relatively large variable displacement high pressure pump. The transition between areas I and II of FIG. 10 requires that as the small fixed displacement boost pump is switched into and out of the flow from the variable displacement main pump, that the variable displacement main pump accommodates this addition and subtraction of flow by respectively subtracting or adding its own flow to prevent any objectionable disruption in the net fluid flow from the hydraulic system to its consumers.

Figure 1:
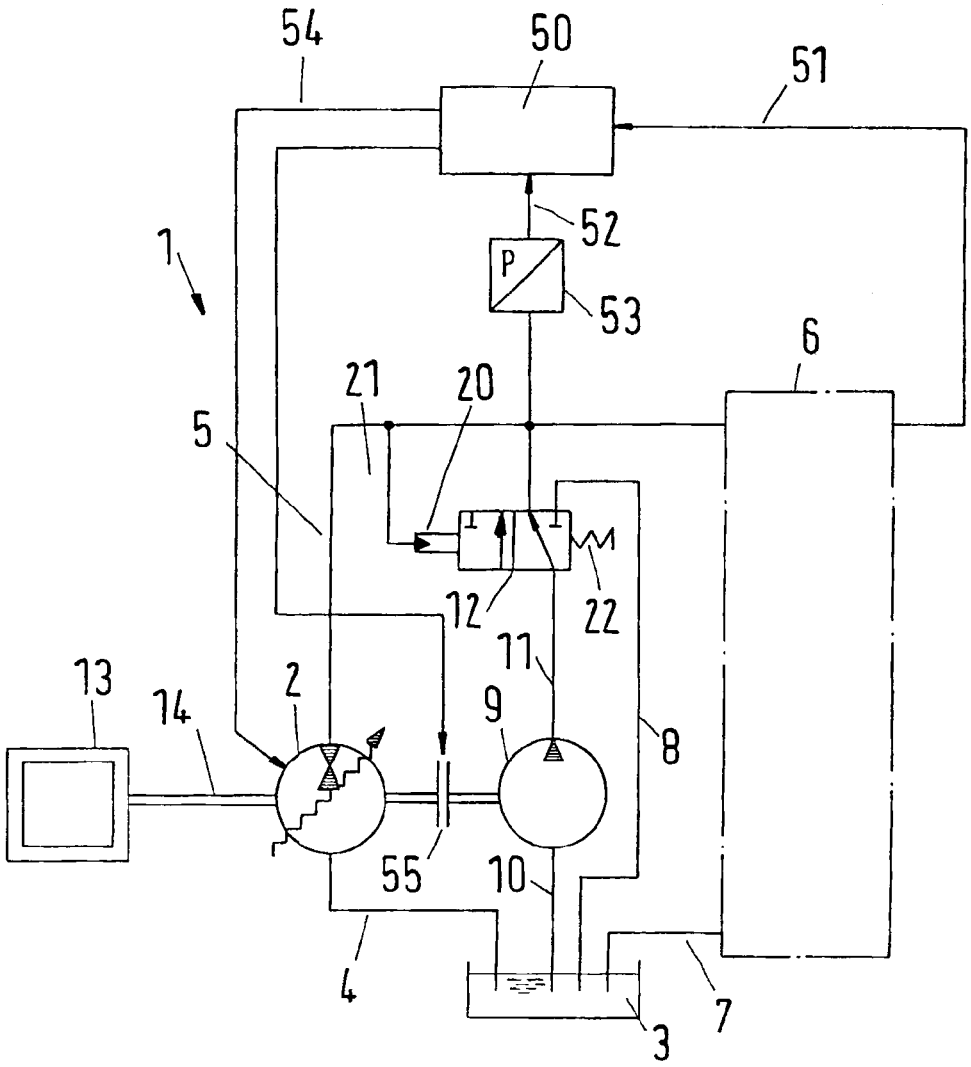
FIG. 1 is a schematic diagram of a first example of a hydraulic system, comprising a hydraulic main pump and a hydraulic boost pump.

In FIG. 1, as an example, a schematic diagram of a first version of a hydraulic system 1 is shown.

The hydraulic system 1 comprises a hydraulic main pump 2, which is in the example shown of the synthetically commutated hydraulic pump type. The main pump 2 sucks in the hydraulic fluid from the fluid reservoir 3 through suction line 4. On the high pressure side of the main pump 2, the hydraulic fluid is led through high pressure line 5 to hydraulic consumer 6. In the example shown, the hydraulic consumer 6 is of a type, where its fluid intake is not necessarily of the same amount as its fluid output. Therefore, the hydraulic system 1, depicted in FIG. 1 is of the open circuit type. The hydraulic fluid, leaving the hydraulic consumer 6 at a lower pressure (approximately at ambient pressure) is returned to the fluid reservoir 3 via a return line 7.

Arranged parallel to the hydraulic main pump 2, a hydraulic boost pump 9 is provided. The boost pump 9 sucks in hydraulic fluid from the fluid reservoir 3 via a second suction line 10. On the high pressure side of the boost pump 9, a boost line 11 is provided, connecting the boost pump 9 to a pressure controlled valve 12. Depending on the position of the pressure controlled valve 12, the boost line 11 is either connected to the high pressure line 5, leading to the hydraulic consumer 6, or the boost line 11 is simply connected to the dump line 8, leading directly to the fluid reservoir 3. Although in FIG. 1, only the two final positions of the pressure controlled valve 12 are shown, in reality valves 12 can be used, that have intermediate states as well.

The maximum achievable pressure of main pump 2 and boost pump 9 is approximately the same in the present example. Both main pump 2 and boost pump 9 are driven by the same mechanical power supply 13. The mechanical power supply 13 can be a combustion engine, an electric motor, a transmission line, a turbine or the like. The mechanical power supply 13 is connected to the main pump 2 and the boost pump 9 via a common rotatable shaft 14.

Furthermore, an electronic controlling unit 50 is provided. The electronic controlling unit 50 uses as input data 51, coming from the hydraulic consumer 6 or other sources. Examples could be speed, torque, necessary flow rate or the like. A second data line 52 collects information about the pressure in the high pressure line 5, collected by pressure transducer 53. On the output side, the controller 50 sends an output signal via output data line 54 to the synthetically commutated main pump 2.

In principle, pressure relief valves could be provided between high pressure line 5 and fluid reservoir 3 and/or between boost line 11 and fluid reservoir 3. It is, however, to be noted, that such pressure relief valves would be mainly safety valves. That is, the fluid flow, demanded by hydraulic consumer 6 is satisfied at the requested level by an appropriate control of synthetically commutated main pump 2. Therefore, the pumping flow will be reduced, if the flow demand decreases. Therefore, no excess fluid (or only a very small amount of excess fluid) has to be dumped during low fluid flow demand conditions.

Principally, synthetically commutated hydraulic main pump 2 could be of a different design, as well. However, synthetically commutated hydraulic pumps are preferred, because their fluid output flow can be changed extremely quickly. This results in a better fluid output flow characteristics of the pump arrangement.

FIG. 1 shows the hydraulic system in a state of high fluid flow demand by the hydraulic consumer 6 (see interval II in FIGS. 4, 9, 10 and 11).

Because of the high fluid flow demand, a single pump (main pump 2 or boost pump 9) is not able to supply the system with an appropriate fluid flow.

Instead, both pumps (main pump 2 and boost pump 9) are needed to provide the necessary fluid flow. The hydraulic system is therefore working in working mode II, (see FIGS. 4 and 10). In this mode, the base load of the hydraulic system 1 is supplied by the fixed fluid flow boost pump 9. The part of the fluid flow demand, exceeding this base load, is supplied by the variable displacement main pump 2. In the example of the hydraulic system 1 of FIG. 1, the controller 50 is arranged in a way, that the high pressure in the high pressure line 5, fed to the hydraulic consumer 6 is slightly lower when working in working mode II as compared to the high pressure in high pressure line 5 during working mode I, so that the pressure control valve 12 can open and close the connection between boost line 11 and high pressure line 5 accordingly.

Accordingly, the controlling cylinder 20 of the pressure control valve 12 (connected to the high pressure line 5 via a sensing line 21) and the counteracting spring 22 of the pressure controlled valve 12 are paired in a way, that the pressure controlled valve 12 switches its state slightly below the maximally achievable pressure 18 of the boost pump 9. Because hydraulic system 1 is operating in working mode II, the fluid flow output of the boost pump 9 is connected to the hydraulic consumer 6 via boost line 11, pressure controlled valve 12 and high pressure line 5. Therefore, the hydraulic consumer 6 is supplied with the combined fluid output flow rates of main pump 2 and boost pump 9. Because main pump 2 is controlled by controller 50 according to the fluid flow demand, it is possible to avoid or at least to significantly decrease an excess combined fluid flow output rate of the pump assembly, (comprising main pump 2 and boost pump 9) which had to be dumped to the fluid reservoir 3 e.g. via pressure controlled valve 12.

Because the boost pump 9 can be chosen to be of a conventional fixed displacement design, very high fluid flow rates can be provided at relatively low cost.

Figure 4:
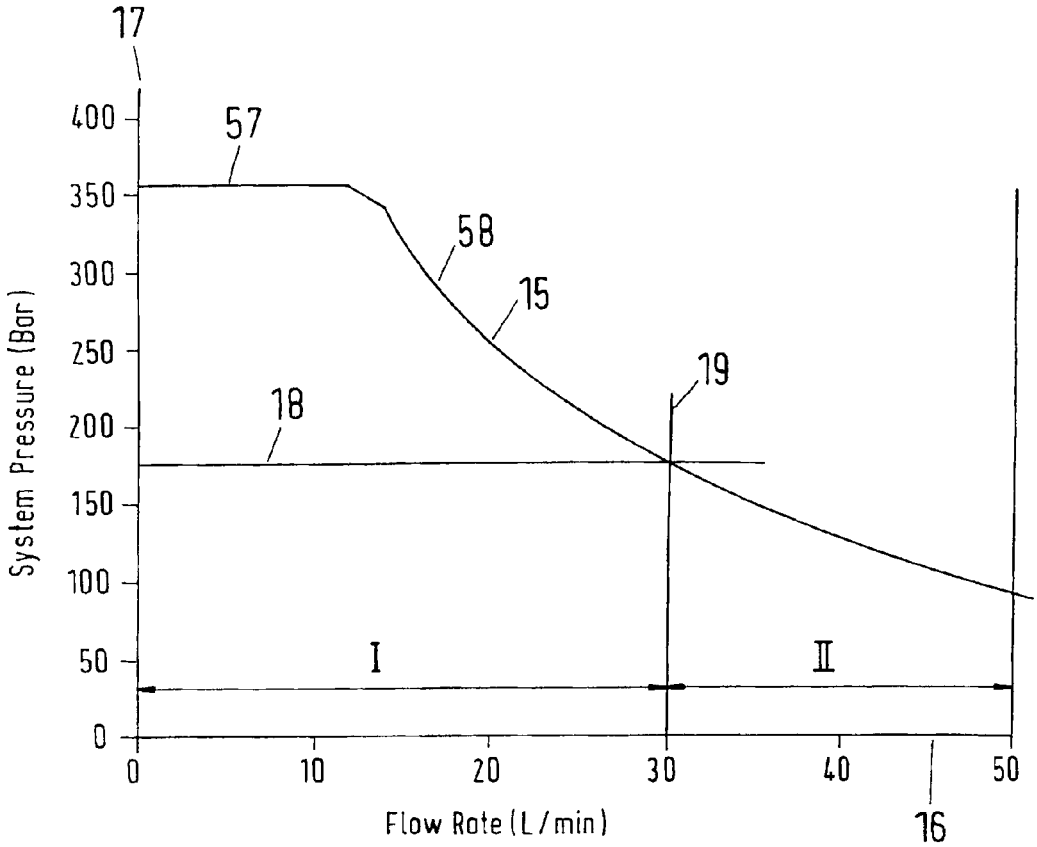
FIG. 4 is a pressure versus flow-rate diagram with power limitation, illustrating different working modes.

If the fluid flow demand of the hydraulic consumer 6 decreases, the controller 50 reduces fluid flow output of hydraulic main pump 2, according to the present conditions 51, 52 of the hydraulic system 1. At some point, the fluid flow demand will drop below the flowrate limit 19, at which point the controller 50 will command the hydraulic main pump in a way that the pressure in the high pressure line 5 will increase slightly above the switching pressure of pressure controlled valve 12. Therefore, pressure controlled valve 12 will change its position, and the hydraulic consumer 6 will be supplied solely by the main pressure pump 2 via high pressure line 5. The hydraulic system is now running in working mode I, as shown in FIG. 4 or 10. Accordingly, boost pump 9 will be switched off, e.g. by disconnecting clutch 55. To compensate for the relatively sudden drop in fluid flow output of boost pump 9 into high pressure line 5, controller 50 commands main pump 2 via signalling line 54 to increase its fluid flow output sharply. Once again it has to be mentioned, that pressure controlled valve 12 is not necessarily of a binary type, so the changes in the transition region 56 are somewhat smeared out.

In the example shown in FIG. 1, in working region I a clutch 55 between high pressure pump 2 and boost pump 9 will be actuated by controller 50, to disengage the connection between mechanical power supply 13 and hydraulic boost pump 9. The engagement/disengagement of clutch 55 can be performed somewhat above the transition region 56. However, it is also possible that the fluid flow output of the boost pump 9 will be simply returned to the fluid reservoir 3 via boost line 11, pressure controlled valve 12 and dump line 8 in working region I. Because boost pump 9 does not have to increase the pressure of the hydraulic fluid (at least not to a level, worth mentioning) before dumping, the mechanical power needed by the boost pump 9 is kept low. In this working mode I, the main pump 2, being variable in its displacement, can change its displacement to satisfy the demand according to the signal of the electronic controller 50.

If the fluid flow demand increases again, boost pump 9 is connected to the mechanical passus 13 through clutch 55 again, the controller 50 sets the pressure and the high pressure line 5 by an appropriate controlling signal 54 to hydraulic main pump 2 in a way that pressure controlled valve 12 opens again and the flow rate, feeding the hydraulic consumer 6 consists of the combined fluid flow rates of main pump 2 and boost pump 9.

Figure 2:
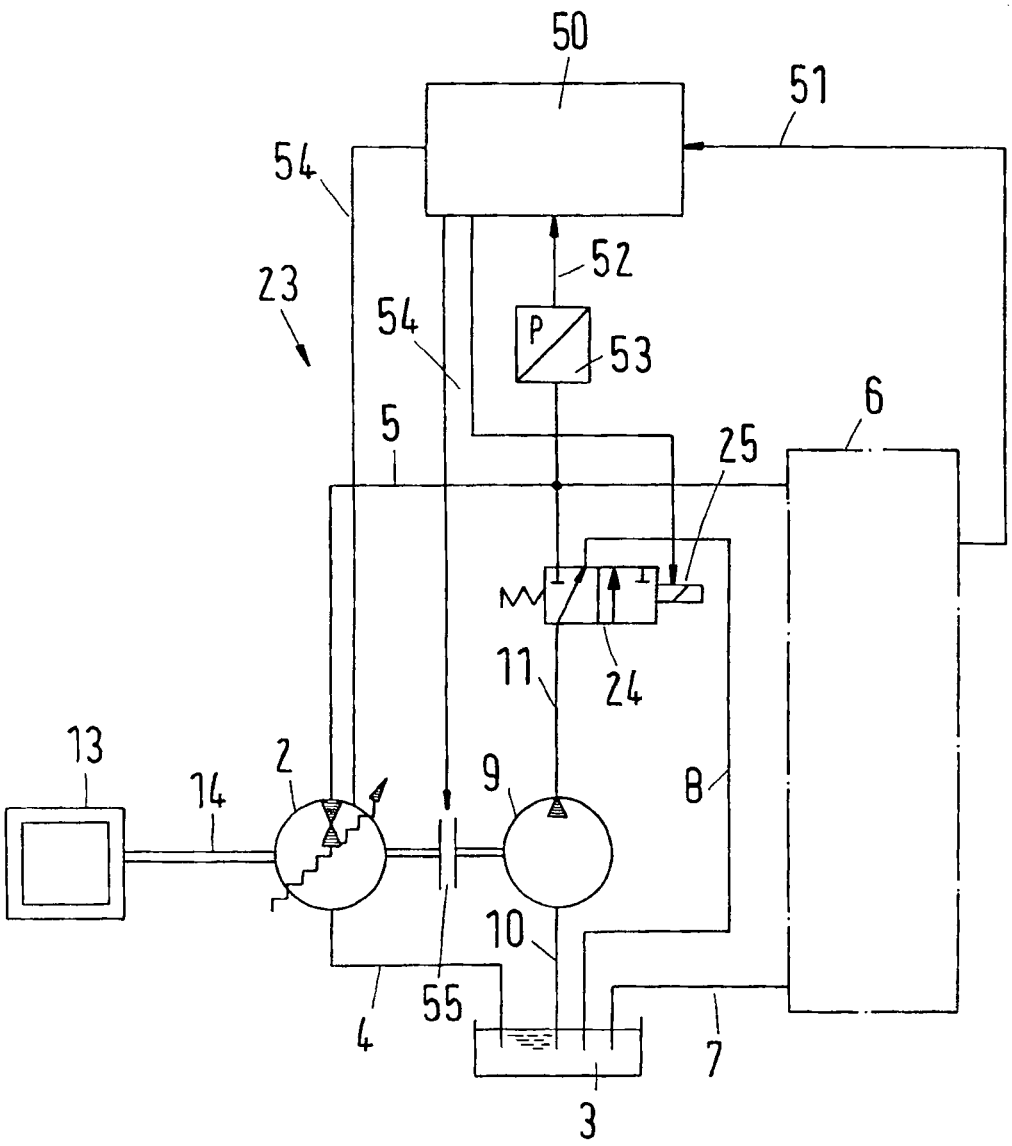
FIG. 2 is a schematic diagram of a second example of a hydraulic system, comprising a hydraulic main pump and a hydraulic boost pump.

In FIG. 2, a slightly modified, second example 23 of the hydraulic system, comprising a high pressure pump 2 and a boost pump 9 is shown. For FIG. 2, as well as for the remaining examples, the same reference numbers will be used for similar parts, for clarity reasons. However, an identical reference number will not necessarily mean that the referenced device is identical to another device with the same number, in design and/or function. However, the design and/or the function will be closely related to that of the other devices with the same reference number.

The second hydraulic system 23, shown in FIG. 2, is quite similar to the first hydraulic system 1, shown in FIG. 1. However, the pressure controlled valve 12 is replaced by an electric valve 24. The electric valve 24 in the hydraulic system 23 shown in FIG. 2, is depicted in a state, where the fluid flow output of the boost pump 9 is directly returned to the fluid flow reservoir 3 via boost line 11, electric valve 24 and dump line 8. The high pressure line 5 is therefore disconnected from boost line 11. In other words, the hydraulic system 23 is running in working mode I of FIG. 4 or 10. Depending on the actual fluid flow demand of hydraulic consumer 6, the fluid flow output rate of main pump 2 is appropriately controlled by controller 50.

If the fluid flow demand increases, the main pump 2 is controlled by electronic controller 50 in a way that the fluid flow output of main pump 2 changes accordingly. At some point, the fluid flow demand will exceed the flow rate which is possible to be supplied by the main pump 2 alone. Therefore, boost pump 9 will be switched on (engaging clutch 55) and the electric valve 24 will be actuated by electronic controller 50 to connect boost line 11 to high pressure line 5. This ports the entire displacement of boost pump 9 to supplement the flow from the main pump 2. When the flow from boost pump 9 is added, the flow from main pump 2 is reduced accordingly to provide a smooth transition to hydraulic consumer 6. If the fluid flow demand continues to rise, the main pump 2 can thus increase its displacement further to increase the flow rate provided.

The electric valve 24 is actuated by a valve actuator 25, which can be controlled by an electronic controlling unit 50 via controlling line 54. Such an electronic controlling unit can use several sensors as input devices and can control the hydraulic system 23 in a way, that an optimal performance of the system can be achieved, with the help of a stored family of characteristic curves, for example. As an example, pressure transducer 53, measuring fluid pressure in high pressure line 5, is used as a sensor for controlling unit 50. Additional input data 51 can be used, i.e. speed, torque and fluid flow demand of hydraulic consumer, for example.

In the example shown in FIG. 2, in working region I a clutch 55 between main pump 2 and boost pump 9 will be actuated by controller 50 to disengage the connection between mechanical power supply 13 and hydraulic boost pump 9. The disengagement of clutch 55 can be performed when the system is operating in working mode I in order to conserve the energy which would be necessary for the boost pump 9 to pump fluid back to fluid reservoir 3 at low pressure through dump line 8. However, it is also possible that the fluid flow output of the boost pump 9 will be simply returned to the fluid reservoir 3 via boost line 11, electrically actuated valve 24 and dump line 8 in working region I without the use of clutch 55.

Figure 9:
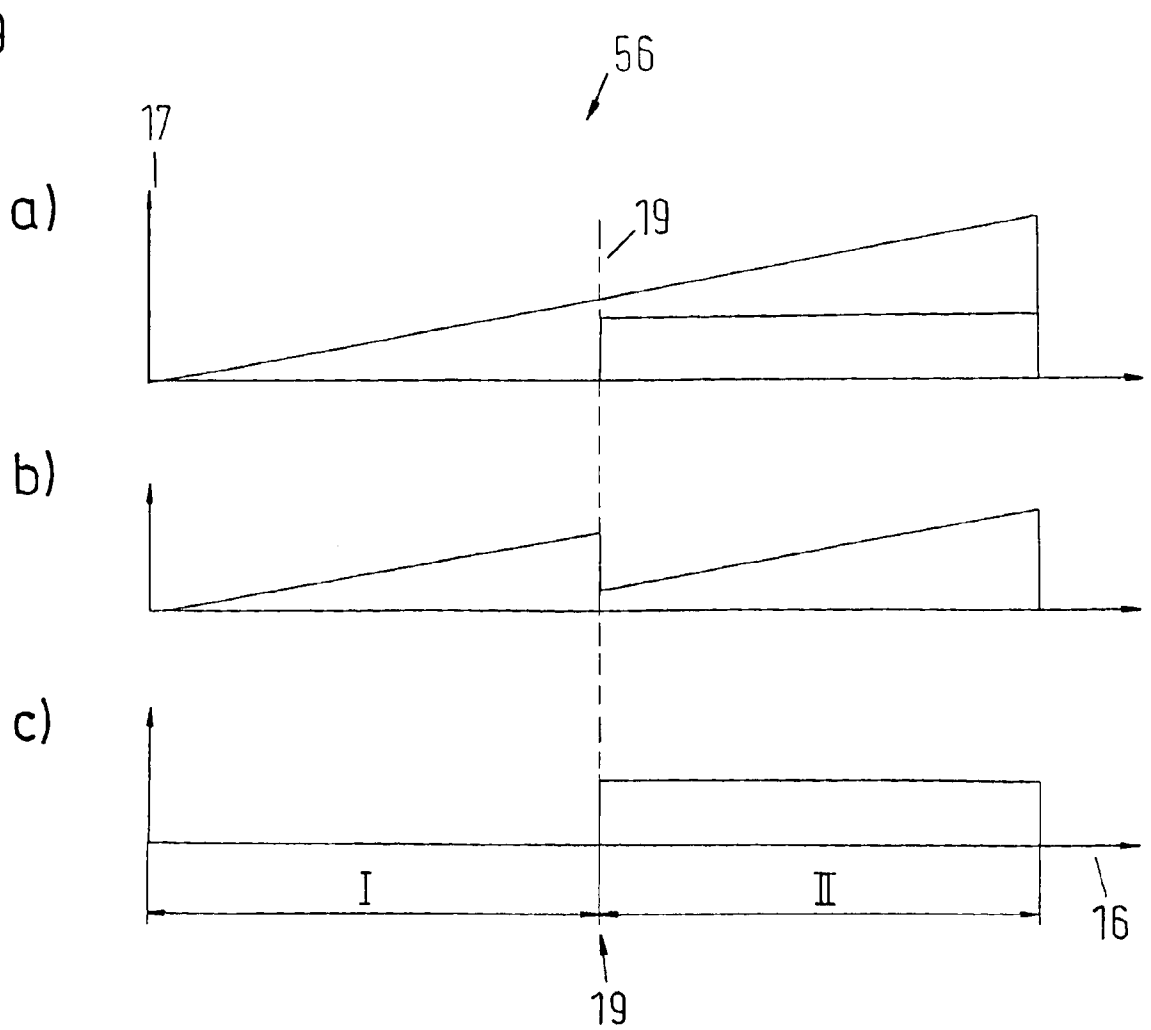
FIG. 9 is a diagram explaining the transition phase between region I and II in FIG. 4.

As described, depending on the actual fluid flow demand of hydraulic consumer 6, the fluid flow output rate of main pump 2 is appropriately controlled by controller 50. The basic principle of this method is illustrated in FIG. 9, where FIG. 9*a* shows the total fluid flow of the pump arrangement, comprising main pump 2 and boost pump 9, FIG. 9*b* shows the fluid flow output rate of main pump 2 and FIG. 9*c* shows the fluid flow output rate into high pressure line 5 by boost pump 9. Boost pump 9 is of a fixed displacement type, i.e. has a constant, non-controllable flow (apart from being able to be switched on and off by clutch 55 or by varying the turning speed of mechanical power supply 13).

As can be seen on the left side (region I) in FIG. 9, the fluid flow towards hydraulic consumer 6 is only supplied by main pump 2. In the transition region 56, near the flow rate limit line 19, electronic controller 50 switches electrically actuated valve 24 via actuator 25 to the opposite position. Therefore, the output fluid flow of boost pump 9 (FIG. 9*c*) is added to the total fluid flow (FIG. 9*a*) of the pump arrangement. To provide for a smooth transition when crossing transition region 56 between working region I and II, the controller 50 commands main pump 2 to reduce its output fluid flow sharply at flow rate limit line 19 (FIG. 9*b*). This can be easily performed with a synthetically commutated hydraulic pump.

In a similar way, if the fluid flow demand drops to a value near the maximum output flow rate of the boost pump 9, the electronic controller 50 will actuate valve 24 to a position where the flow from boost pump 9 is directed to fluid reservoir 3 via boost line 11, electrically actuated 24 and dump line 8. To compensate for the relatively sudden drop in fluid flow output of boost pump 9 into high pressure line 5, controller 50 will also command main pump 2 via signalling line 54 to increase its fluid flow output sharply to provide a smooth transition to hydraulic consumer 6. This transition is further explained in connection with FIG. 9.

Because the boost pump 9 can be chosen to be of a conventional, fixed fluid flow design, very high fluid flow rates can be provided at much lower cost when compared with synthetically commutated hydraulic pumps. Therefore, the overall hydraulic system 23 is relatively inexpensive, but because the main pump 2 is of a synthetically commutated type, the hydraulic system 23 retains almost all the same functionality as a hydraulic system in which a main pump with a high maximum fluid output flow is provided. Essentially, the high functionality of the synthetically commutated hydraulic main pump is extended over a larger flow rate range by the use of the boost pump concept.

Figure 3:
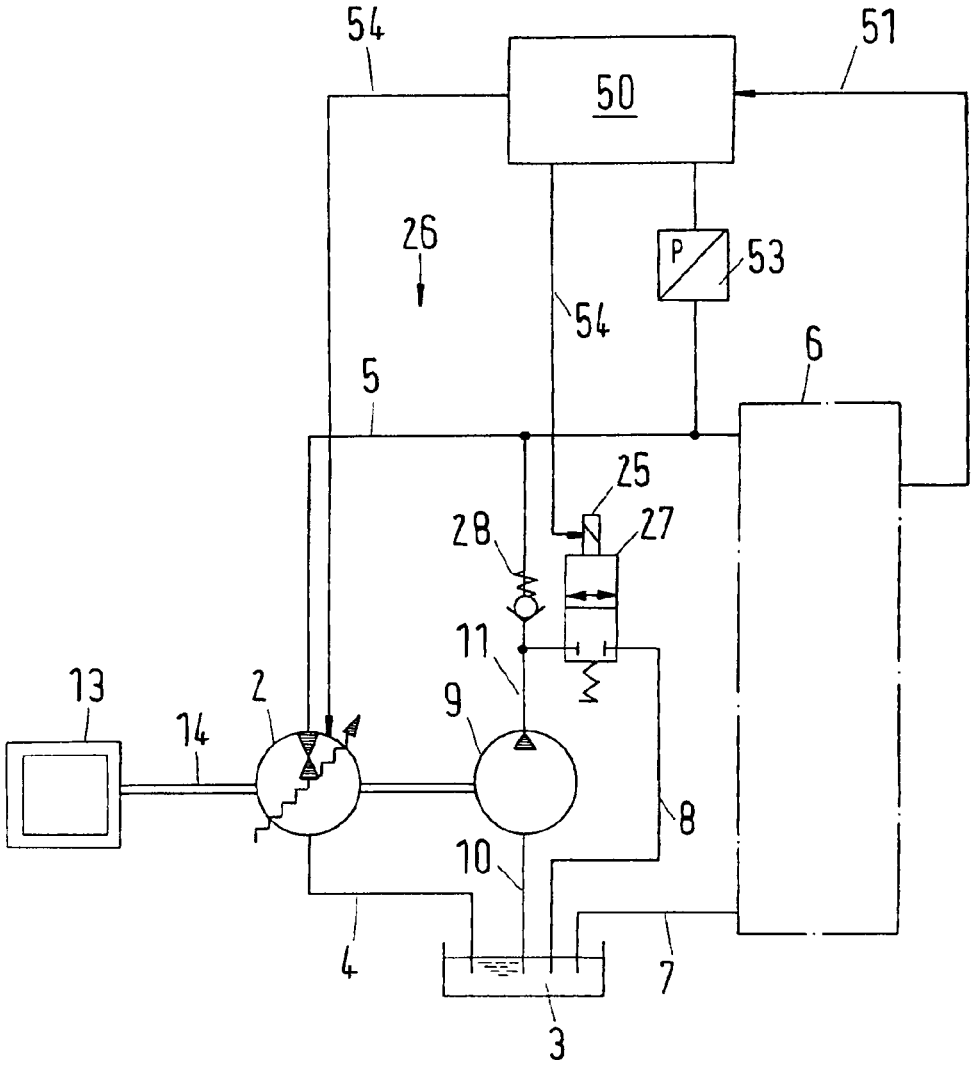
FIG. 3 is a schematic diagram of a third example of a hydraulic system, comprising a hydraulic main pump and a hydraulic boost pump.

In FIG. 3, another possible design of a hydraulic system 26 is shown. In this example, the hydraulic circuitry of the hydraulic system 26 is slightly modified, as compared to the examples shown in FIGS. 1 and 2.

The boost line 11, connected to the fluid output side of the boost pump 9, is split up in two branches. First branch is connected to the dump line 8 leading directly to the fluid reservoir 3, via an electrically actuated solenoid valve 27. A second branch of the boost line 11 is connected via a spring loaded check valve 28 to the high pressure line 5. The opening direction of the check valve 28 is chosen in a way that it will be closed if the pressure in the high pressure line 5 is higher than the pressure in the boost line 11, and will be open, if the pressure in the boost line 11 is higher than the pressure in the high pressure line 5.

The electrically actuated solenoid valve 27 is controlled by an electronic controlling unit 50, similarly to the hydraulic system 23, shown in FIG. 2.

The electronic controlling unit 50 determines which working mode (I or II; compare with FIGS. 4, 9, 10 and 11) is active by controlling solenoid valve 27. If the controlling unit 50 determines that working mode I is appropriate (low fluid flow demand), then solenoid valve 27 will be in a position where boost line 11 and dump line 8 are connected. This allows boost pump 9 to operate in a low power condition to conserve energy. Of course, it would be also possible to provide a clutch, which could be disconnected in this working mode I. A pressure in high pressure line 5 will keep check valve 28 closed in this condition. If however the controlling unit 50 determines that working mode II is appropriate (high fluid flow demand), then solenoid valve 27 will be in a position where boost line 11 and dump line 8 are not connected. The fluid being output by boost pump 9 can no longer flow to dump line 8 and will then raise pressure in boost line 11 above the pressure necessary to open check valve 28, finally contributing its flow to that of main pump 2 in high pressure line 5. A pressure relief valve (not shown) contained in hydraulic consumer 6 and/or solenoid valve 27 will protect the boost pump 9 and/or the main pump 2 from overpressure damage regardless of the position of solenoid valve 27.

FIG. 4 shows the functional connection between the achievable maximum hydraulic fluid flow rate and the achievable maximum system pressure for a case, where the maximum output fluid power is limited in some way; for example: The available power from mechanical power supply 13 is limited. The flow rate is plotted in liters per minute on the abscissa 16. The system pressure is plotted in bars on the ordinate 17. Functional connection between achievable maximum system pressure and achievable maximum flow rate for approximately constant maximum power from the mechanical power supply 13 is shown by the function line 15. Of course, every point below limiting function line 15 can be achieved as well. Furthermore, the maximum pressure, the boost pump 9 is able to provide, is depicted in form of a boost pressure limit line 18. The intercepting point of the boost pressure limit line 18 and the function line 15 defines the flow rate limit line 19. The plateau 57 in curve 15 is determined by the maximum pressure of main pump 2. The curved area 58 of curve 15 is determined by the mechanical power supply 13.

If the flow rate is below the limiting flow rate, indicated by flow rate limit line 19, the hydraulic system will run in working mode I. In working mode I the maximum pressure is limited only by the maximum pressure 57 of the main pump 2. In working mode I, the hydraulic consumer will only be supplied by the main pressure pump 2.

If the flow rate demand is higher than the flow rate limit 19, the hydraulic system will run in working mode II, located on the right side of flow rate limit line 19 in FIG. 4. This is a mode, where a high hydraulic fluid flow demand is present and because the mechanical power supply power is limited in this case, the system pressure is consequently accordingly low. In this mode, the hydraulic consumer will be supplied by both main pump 2 and boost pump 9.

Of course, the same principle applies also, if a plurality of main pumps 2 and/or a plurality of boost pumps 9 is provided. This will be further elucidated later on in connection with FIG. 11.

The type of system which is represented by FIG. 4 is of special significance to the present invention because of the limited available power of the mechanical power supply 13. Because of this power limit, whenever there is a high fluid flow demand in working mode II, the system pressure cannot be higher than line 18. Thus, the boost pump 9 for such a system can also be of a lower pressure rating than the hydraulic main pump 2. This allows for further reduced systems costs.

The two working modes I and II are shown in FIG. 9 as well. FIG. 9 shows the different output fluid flow rates: FIG. 9*a* shows the total output fluid flow of the pump arrangement, comprising main pump 2 and boost pump 9. FIG. 9*b* shows the fluid output flow of main pump 2 while FIG. 9*c* shows the output fluid flow of boost pump 9. On the abscissa 16 the requested fluid flow rate is plotted. On the ordinate 17 the respective output fluid flow rate is shown.

As can be seen from FIG. 9, in the transition region 56 around flow rate limit line 19, the output fluid flow of boost pump will be added suddenly (FIG. 9*c*). To compensate for this and to provide a smooth total output fluid flow (FIG. 9*a*), the output fluid flow of main pump 2 (FIG. 9*b*) has to be reduced appropriately in the transition region 56. Also, in the transition region 56, around flow rate limit line 19, there should preferably be some type of hysteresis implemented in the electronic controller 50 to prevent rapid switching in and out of the boost pump 9.

Figure 11:
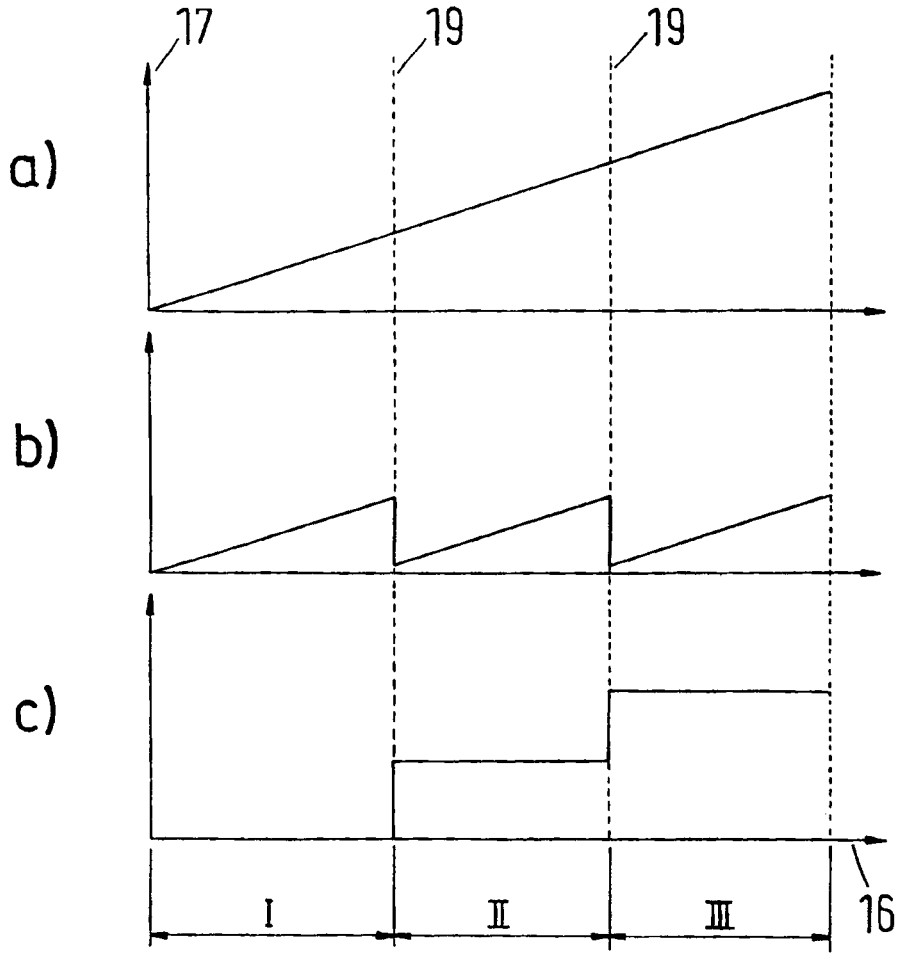
FIG. 11 is a diagram explaining the use of multiple boost pumps with a single hydraulic main pump.

FIG. 11 shows an example of how the variable flow range of a single main pump 2 can be further extended by the use of multiple boost pumps 9. At each transition 19, the boost pump's 9 flow (i.e. the output flow of one or of several boost pumps, depending on the actual working interval; see FIG. 11*c*) is combined with the main pump's 2 flow (FIG. 11*b*) while the main pump's 2 flow is quickly accordingly reduced to foster a smooth transition in the net output flow (FIG. 11*a*). Thus, in working mode III, the boost pumps 9 are providing a fixed amount of flow while the main hydraulic pump 2 continues to modulate the fluid flow rate to satisfy the system demand.

Figure 5:
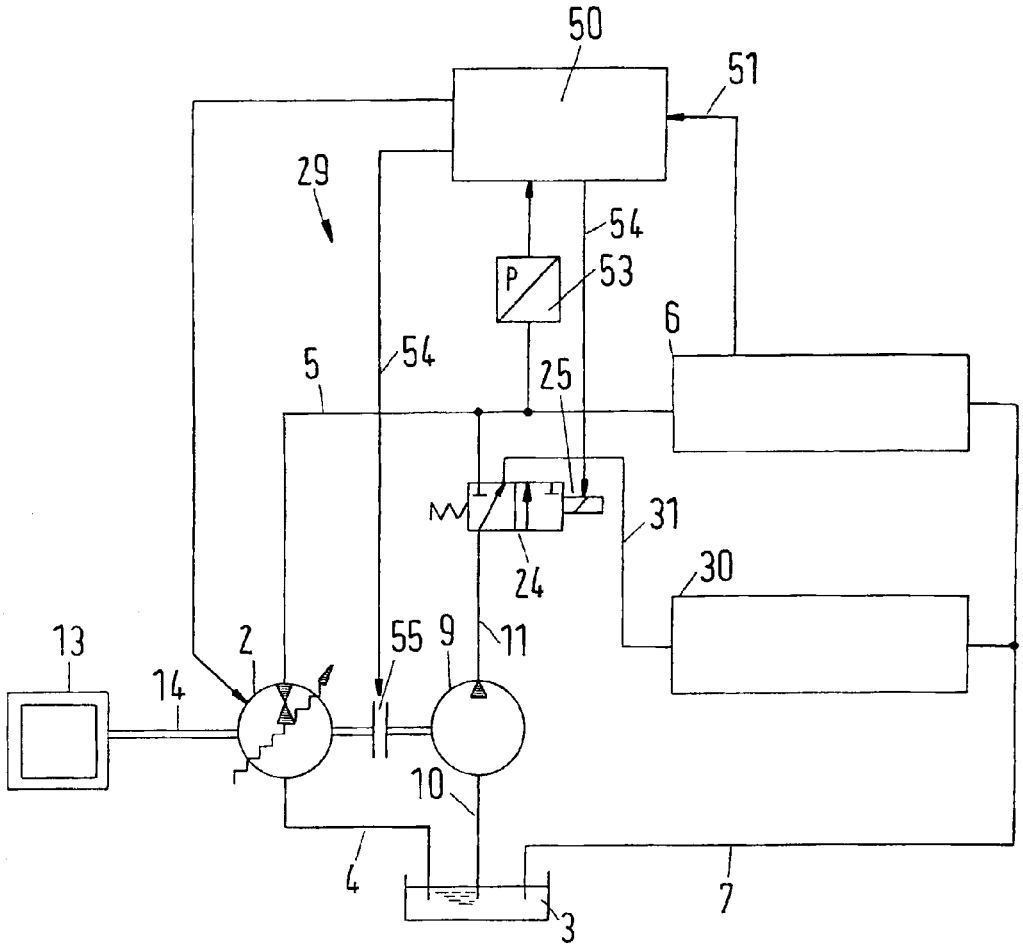
FIG. 5 is a schematic diagram of a fourth example of a hydraulic system, comprising a hydraulic main pressure pump and a hydraulic boost pump.

In FIG. 5, yet another hydraulic system 29 is shown. The hydraulic system 29 of FIG. 5 is essentially a modification of the hydraulic system 23 shown in FIG. 2.

The two hydraulic systems 29 and 23 differ in the way in which the electric valve 24 is connected to the fluid reservoir 3. As already explained, in FIG. 2 the fluid output flow of boost pump 9 is directly returned to the fluid reservoir via a dump line 8, if the system is running in working mode I.

This is different in the hydraulic system 29, shown in FIG. 5. If the hydraulic system runs in working mode I (as shown), i.e. in a mode where the hydraulic consumer 6 is supplied only by the hydraulic main pump 2, the hydraulic fluid pumped by the boost pump 9 is first directed to a second hydraulic consumer 30, a boost line 11, electric valve 24 and connecting line 31. Only afterwards, i.e. after leaving the second hydraulic consumer 30, the hydraulic fluid is returned to the fluid reservoir 3.

With the proposed arrangement, the boost pump 9 can be used for performing useful work, even if the boost pump 9 is not useful in connection with supplying hydraulic consumer 6 with hydraulic fluid. Therefore, the resulting hydraulic system 29 can be even more cost-effective.

As a second hydraulic consumer 30, a hydraulic consumer should be chosen, which does not have to run on high priority. Furthermore, a second hydraulic consumer 30, which can be switched off, even for prolonged periods of time, would be ideal. However, an algorithm could be implemented in the controlling unit 50, controlling electric valve 24, so that second hydraulic consumer 30 will be supplied with hydraulic fluid at least from time to time. This, of course, can influence the performance of first hydraulic consumer 6.

Figure 6:
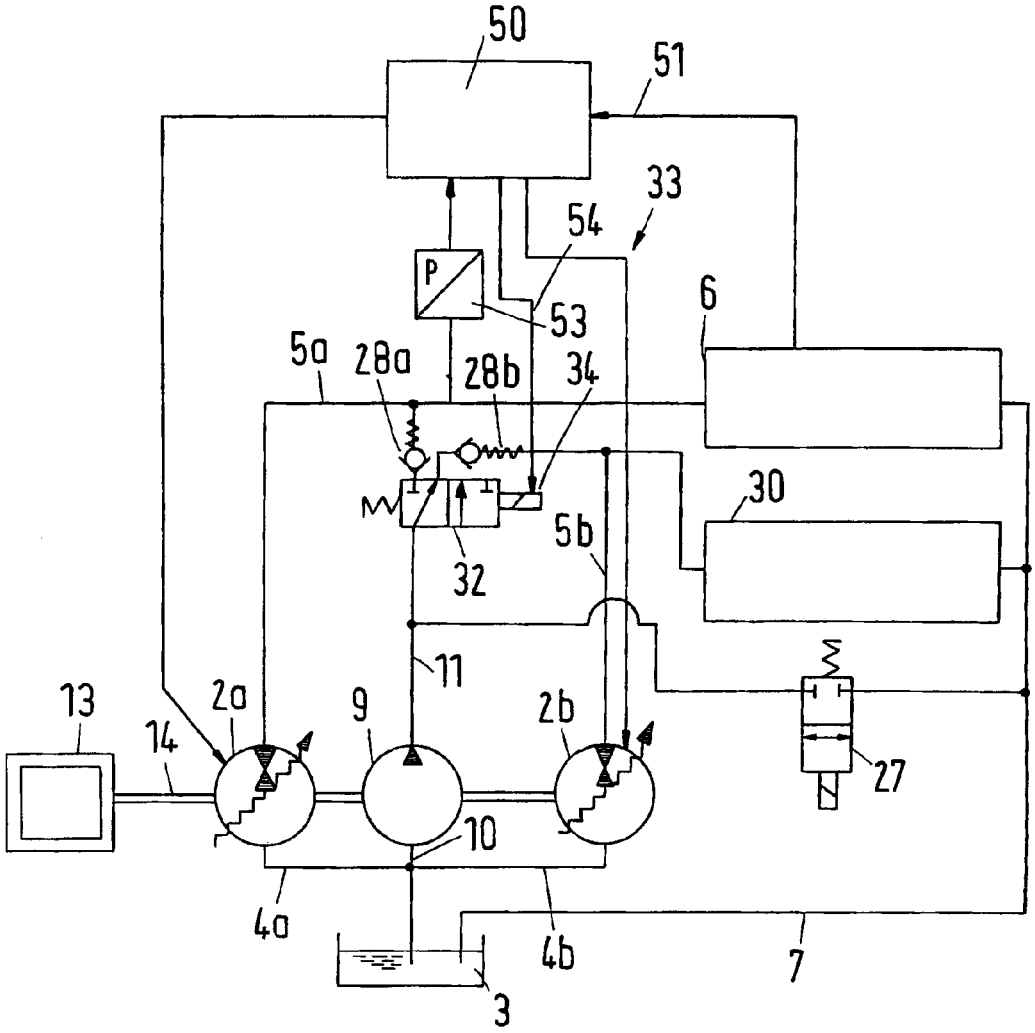
FIG. 6 is a schematic diagram of a fifth example of a hydraulic system, comprising two hydraulic main pumps and one hydraulic boost pump.

In FIG. 6 yet another example of a hydraulic circuit 33 is shown. In this hydraulic circuit 33, two main (e.g. high pressure) pumps 2*a* and 2*b* are provided, along with a single boost pump 9 (e.g. low-pressure pump). The two main pumps 2*a*, 2*b* and the boost pump 9 are all driven by the same mechanical power supply 13 via a common rotating shaft 14. The first main pump 2*a* is connected to a first hydraulic consumer 6 via a first high pressure line 5*a*. Analogously a second hydraulic consumer 30 is connected to the second main pump 2*b* via high pressure line 5*b*. Put in other words, main pump 2*a* is the dedicated main pump for the first hydraulic consumer 6, while second main pump 2*b* is the dedicated main pump for the second hydraulic consumer 30.

For both hydraulic consumers 6 and 30, only a single boost pump 9 is provided. Depending on the fluid flow demand of the hydraulic consumers 6, 30, electric switching valve 32 and/or solenoid valve 27 are switched to an appropriate position by an electronic controlling unit 50.

In a situation, where first hydraulic consumer 6 is running in working mode I and second hydraulic consumer 30 is running in working mode II (compare with FIG. 4, 9), the valves 27, 34 are set to the positions, shown in FIG. 6. Therefore, first hydraulic consumer 6 is supplied at a low flow rate (and possibly on a high pressure level) by its dedicated main pump 2*a* via high pressure line 5*a*. Hydraulic consumer 30, however, is running in working mode II, i.e., the hydraulic consumer 30 has a high fluid flow demand (and the pressure demand is possibly low). Therefore, the second hydraulic consumer 30 is not only supplied by its dedicated high pressure pump 2*b*, but also by the fluid flow output of the boost pump 9.

If the fluid flow demands of the two hydraulic consumers 6, 30 are interchanged (first hydraulic consumer in working mode II, second hydraulic consumer 30 in working mode I), switching valve 32 is set to its opposite position.

In case electronic controller 50 determines that both hydraulic consumers 6, 30 should run in working mode I, solenoid valve 27 will be opened to direct flow form boost pump 9 through solenoid valve 27 and return line 7 to the fluid reservoir 3. The function and purpose of solenoid valve 27 is described in detail with respect to hydraulic circuit 26, shown in FIG. 3.

Figure 7:
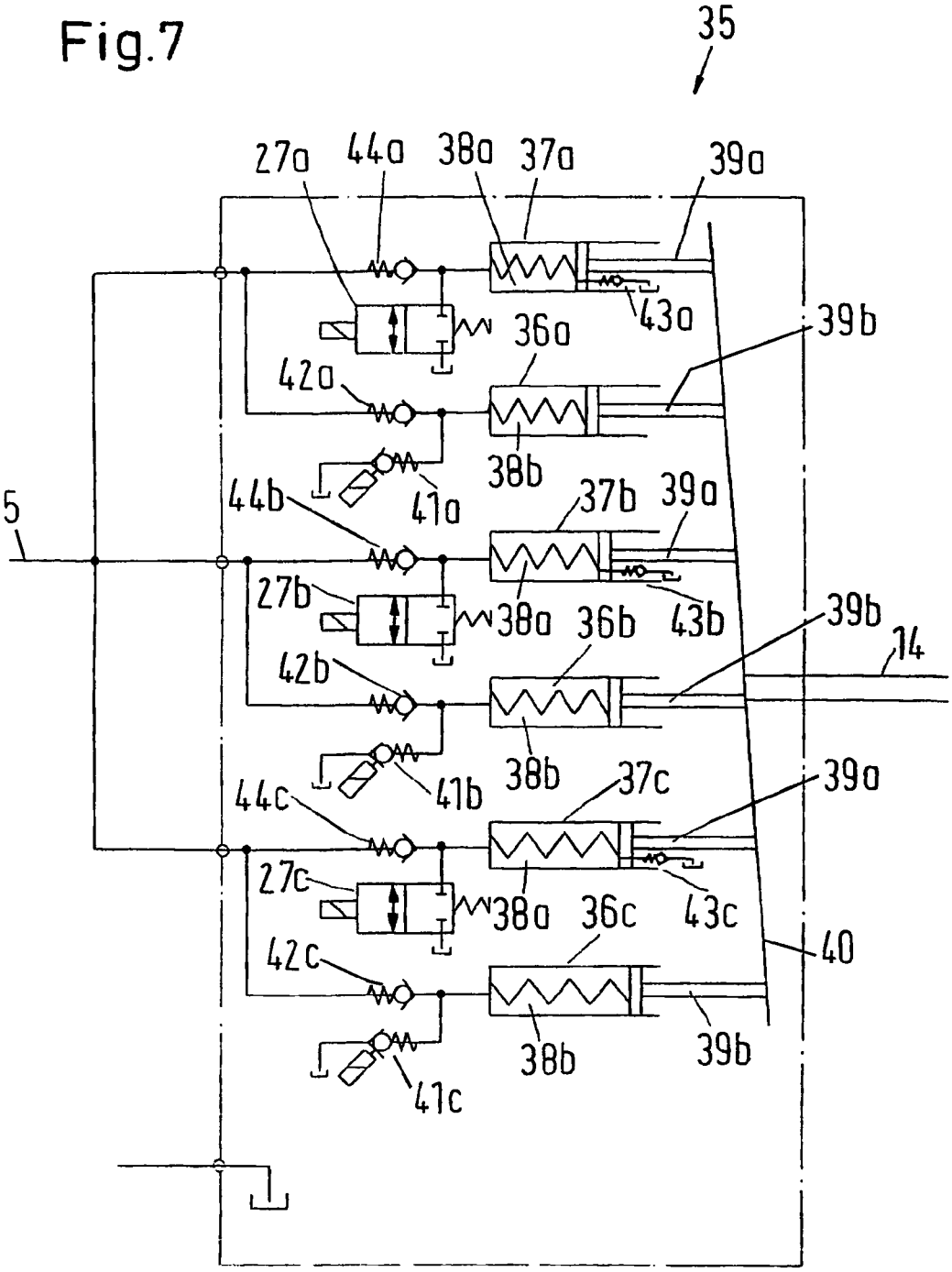
FIG. 7 is a schematic diagram of the hydraulic circuitry of a combined high-pressure-low-pressure pump.

FIG. 7 gives an example, on how a combined hydraulic main pump/hydraulic boost pump pumping system 35 could be realised for practical purposes. As a non limiting example, the pump arrangement of the hydraulic system 26 of FIG. 3 is used. In FIG. 7, a schematic diagram of a possible arrangement of such a combined pumping system 35 is given. The combined pumping system 35 comprises six working chambers 36*a*, 36*b*, 36*c*, 37*a*, 37*b*, 37*c*. Working chambers 36*a*, 36*b*, 36*c*, 37*a*, 37*b*, 37*c* each comprise a cylinder space 38*a*, 38*b* and a piston 39*a*, 39*b*, wherein each piston 39*a*, 39*b* is reciprocating in and out of its corresponding cylinder space 38*a*, 38*b*. The reciprocating movement of pistons 39*a*, 39*b* is produced by a wobble plate 40, which is rotated by a rotatable shaft 14.

The six working chambers 36*a*, 36*b*, 36*c*, 37*a*, 37*b*, 37*c* fall into two different groups, i.e. into a group of three main working chambers 36*a*, 36*b*, 36*c* and a group of three boost working chambers 37*a*, 37*b*, 37*c*. The main chambers 36*a*, 36*b*, 36*c*, are connected with corresponding synthetically actuated inlet valves 41*a*, 41*b*, 41*c* and corresponding spring loaded outlet valves 42*a*, 42*b*, 42*c*. Therefore, a synthetically commutated hydraulic main pump comprising three working chambers 36*a*, 36*b*, 36*c* is provided.

Furthermore, the three boost working chambers 37*a*, 37*b*, 37*c* are connected with corresponding spring loaded inlet valves 43*a*, 43*b*, 43*c* and spring loaded outlet valves 44*a*, 44*b*, 44*c*, essentially forming a classic style three piston hydraulic pump. Furthermore, solenoid valves 27*a*, 27*b*, 27*c* are connected with the boost working chambers 37*a*, 37*b*, 37*c* for dumping the hydraulic fluid into the fluid reservoir 3, if no demand for hydraulic fluid, pumped by the boost pump working chambers 37*a*, 37*b*, 37*c* is present.

Of course, slight modifications in the circuitry of FIG. 7 can be provided as well. For example, the overall fluid output flow does not necessarily have to be joined into a common high pressure line 5. Instead, the high pressure output of the synthetically commutated working chambers 36*a*, 36*b*, 36*c* and/or the output of the classic style boost working chambers 37*a*, 37*b*, 37*c* can be fed to several hydraulic consumers through several fluid lines (see FIG. 6 for example).

Figure 8:
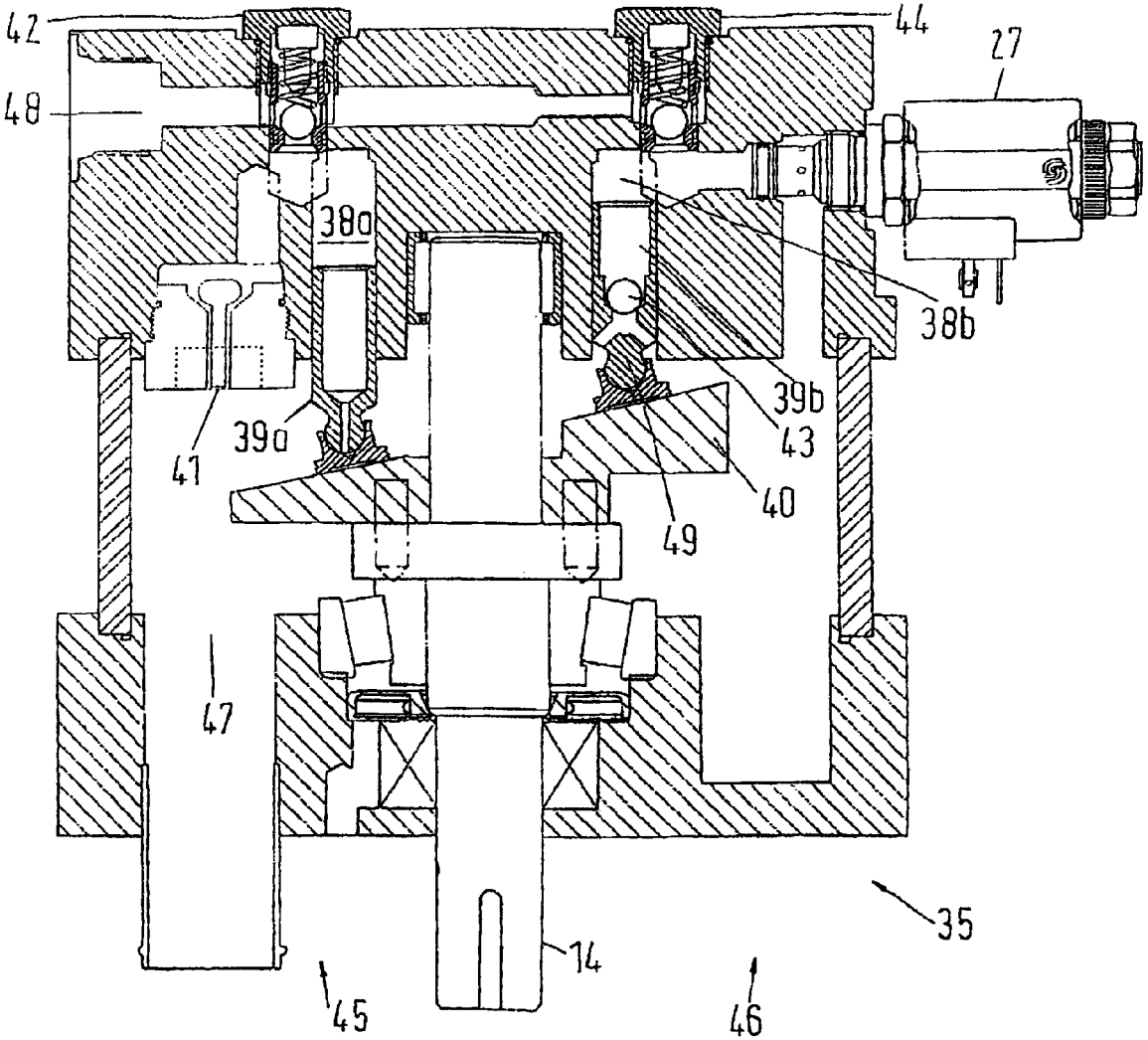
FIG. 8 is a cross section of a combined hydraulic pump, comprising a high pressure pump section and a boost pump section.

FIG. 8 shows a cross section of a possible embodiment of a combined pumping system 35 according to the schematic diagram of FIG. 7.

On the left side of FIG. 8, a synthetically commutated section 45 of the combined pumping system 35 is shown, whereas on the right side of FIG. 8, a boost pump section 46 of the combined pumping system 35 is shown.

The inlet channel 47 of the pumping system 35 is connected to a suction line 4, while the outlet channel 48 is connected to a high pressure line 5. The rotatable shaft 14 is connected to wobble plate 40. The pistons 39*a*, 39*b* (irrespective of whether they are pistons 39*a* of the synthetically commutated part 45 or pistons 39*b* of the boost pumping part 46) are connected to the wobble plate 40 by a ball socket connection 49, so that they can be twisted relative to the wobble plate 40.

In the synthetically commutated pumping section 45, the inlet valve 41 is of a synthetically actuated type, i.e. it is electrically switchable and controlled by a electronic controlling unit (not shown). By appropriate control of the synthetically actuated inlet valve 41 in combination with the cyclically changing working space 38*a* and the spring loaded outlet valve 42, hydraulic fluid is pumped from the inlet section 47 at ambient pressure to the high pressure side, i.e. to outlet channel 48.

On the boost pumping side 46 of the pumping system 35 both inlet valve 43 and outlet valve 44 are spring loaded check valves. In combination with the cyclically changing working space 38*b*, a classical style hydraulic pump is provided.

The pumping system 35 can be of a design that the maximum pressure, which can be achieved by this boost pump section 46 is lower than the maximum pressure, achievable by the synthetically commutated pump side 45 of the pumping system 35. Of course, a design in which the maximum pressure achievable by the boost pump section 46 can be the same as the maximum pressure achievable by the synthetically commutated pump side 45 of the pumping system 35 is also possible.

Furthermore, a solenoid valve 27 is provided. In case electronic controller 50 determines that the required outlet flow through outlet channel 48 should be satisfied by the synthetically commutated pump side 45 alone, the boost pump working chamber 38*b* can be short-circuited to fluid reservoir 3 via solenoid valve 27.

While the present invention has been illustrated and described with respect to a particular embodiment thereof, it should be appreciated by those of ordinary skill in the art that various modifications to this invention may be made without departing from the spirit and scope of the present.

What is claimed is:

1. A hydraulic system comprising:

at least one hydraulic main pump driven by a power supply, the at least one hydraulic main pump being a variable displacement pump; and at least one hydraulic boost pump selectively driven by said power supply, the at least one hydraulic boost pump being a fixed displacement pump;

wherein the at least one hydraulic main pump and at least one hydraulic boost pump are configured to supply an output fluid flow to at least one hydraulic consumer;

wherein, in a low fluid flow mode, the at least one hydraulic boost pump is not driven by said power supply such that the at least one hydraulic main pump supplies the output fluid flow to the at least one hydraulic consumer;

wherein, in a high fluid flow mode, the at least one hydraulic boost pump is driven by said power supply so that the at least one hydraulic boost pump and the at least one hydraulic main pump supply the output fluid flow to the at least one hydraulic consumer;

wherein the output fluid flow to the at least one hydraulic consumer is higher in the high fluid flow mode than in the low fluid flow mode.

2. The hydraulic system according to claim 1, wherein a maximum output pressure, achievable by the at least one hydraulic main pump is higher than a maximum output pressure, achievable by the at least one hydraulic boost pump.

3. The hydraulic system according to claim 1, wherein the at least one hydraulic main pump is of a synthetically commutated type.

4. The hydraulic system according to claim 1, wherein the output fluid flow to the at least one hydraulic consumer in the high fluid flow mode is regulated essentially by the at least one hydraulic main pump.

5. The hydraulic system according to claim 1, wherein the at least one hydraulic boost pump is of a cylinder-and-piston type.

6. The hydraulic system, according to claim 1, wherein a maximum fluid flow rate of the at least one hydraulic main pump is higher than a maximum fluid flow rate of the at least one hydraulic boost pump.

7. The hydraulic system according to claim 1, wherein the power supply driving the at least one hydraulic main pump and the at least one hydraulic boost pump is a single motor.

8. The hydraulic system according to claim 1, further comprising at least one electric valve.

9. The hydraulic system according to claim 1 comprising at least two hydraulic consumers and at least two hydraulic main pumps.

10. The hydraulic system according to claim 9, wherein the at least one hydraulic boost pump can be selectively connected to one or more of the at least two hydraulic consumers.

11. A hydraulic system comprising:

a combined pumping system driven by a power supply, the combined pumping system comprising a main pumping section providing variable displacement and a boost pumping section providing a fixed displacement;

wherein the main pumping section and the boost pumping section are configured to supply an output fluid flow to at least one hydraulic consumer;

wherein, in a low fluid flow mode, the main pumping section is driven by said power supply but the boost pumping section is not driven by said power supply such that the main pumping section supplies the output fluid flow to the at least one hydraulic consumer;

wherein, in a high fluid flow mode, the main pumping section and the boost pumping section are driven by said power supply so that the main pumping section and the boost pumping section supply the output fluid flow to the at least one hydraulic consumer;

wherein the output fluid flow to the at least one hydraulic consumer is higher in the high fluid flow mode than in the low fluid flow mode.

12. The hydraulic system according to claim 11, wherein the combined pumping system further comprises an electrically actuated valve for short-circuiting the boost pumping section to a fluid reservoir.

* * * * *